US007499562B2

(12) United States Patent
Shim

(10) Patent No.: US 7,499,562 B2
(45) Date of Patent: Mar. 3, 2009

(54) VIRTUAL MULTI-CHANNEL SPEAKER UNIT

(76) Inventor: Soon-Teak Shim, 331-2, Sansung-dong, Jung-gu, Daejeon City (KR) 301-819

( * ) Notice: Subject to any disclaimer, the term of this patent is extended or adjusted under 35 U.S.C. 154(b) by 428 days.

(21) Appl. No.: 10/572,527

(22) PCT Filed: Oct. 9, 2003

(86) PCT No.: PCT/KR03/02074

§ 371 (c)(1),
(2), (4) Date: Mar. 20, 2006

(87) PCT Pub. No.: WO2005/029909

PCT Pub. Date: Mar. 31, 2005

(65) Prior Publication Data

US 2007/0121986 A1 May 31, 2007

(30) Foreign Application Priority Data

Sep. 22, 2003 (KR) ..... 10-2003-0065462

(51) Int. Cl.
*H04R 25/00* (2006.01)

(52) U.S. Cl. ..... 381/382; 381/384

(58) Field of Classification Search ..... 379/430; 381/337, 338, 345, 348, 349, 370, 371, 372, 381/376, 381, 382, 384
See application file for complete search history.

(56) References Cited

U.S. PATENT DOCUMENTS 4,239,945 A * 12/1980 Atoji et al. ..... 381/371
6,307,943 B1 10/2001 Yamagishi

FOREIGN PATENT DOCUMENTS

KR 19990017760 6/1999
KR 20010103813 11/2001

* cited by examiner

*Primary Examiner*—Brian Ensey
(74) *Attorney, Agent, or Firm*—The Webb Law Firm

(57) ABSTRACT

Disclosed is a virtual multi-channel speaker unit, comprising a casing having a transmission portion through which sounds pass; a solenoid coil arranged in the casing and applied with acoustic signals; a magnetic body around which the solenoid coil is wound to form magnetic field; a diaphragm that faces one side of the magnetic body and vibrates to transmit sound waves through the transmission portion; and a transmission conduit having an inlet hole through which sound waves and compressed air generated behind the diaphragm upon the vibration of the diaphragm are introduced, and an outlet hole for discharging the sound waves and compressed air introduced through the inlet hole, the inlet hole being connected to a portion of the backside of the casing, the outlet hole being oriented toward the front of the diaphragm.

7 Claims, 7 Drawing Sheets

Prior Art

VIRTUAL MULTI-CHANNEL SPEAKER UNIT

TECHNICAL FIELD

The present invention relates to a virtual multi-channel speaker unit and, more particularly, to a virtual multi-channel speaker unit in which a casing of a speaker unit, such as an earphone used for a sound reproducing device like CDP and MP3 player, is physically shaped into a specific form to form a virtual channel of the speaker and which can cancel air pressure applied to a user's eardrum to reduce fatigue and improve sound quality of the speaker.

BACKGROUND ART

A speaker refers to a device that converts an electric signal into an acoustic signal. The speaker operates in such a manner that, when an electric signal is applied to a solenoid coil included in a casing of the speaker, electromagnetic field is formed in the solenoid coil and a permanent magnet around which the solenoid coil is wound. At this time, a diaphragm one side of which faces the permanent magnet vibrates to oscillate the surrounding air to convert the electric signal into an acoustic signal, thereby generating a sound.

FIG. 6 shows various types of speaker units. The speaker unit is divided into an acoustic suspension speaker unit 60*a* and a reflex speaker unit 60*b* in terms of external shape. The acoustic suspension speaker unit is constructed in such a manner that the entire face of its enclosure 62*a*, excepting a hole (not shown) formed in its speaker 61*a*, is closed for the external environment and a sound-absorbing material is attached onto the inner side of the enclosure 62*a* to prevent sounds generated from the inside of the speaker unit from being emitted to the outside.

The reflex type speaker unit, generally called a bass reflex or out-of-phase speaker unit, has a duct 63 formed at the front or back side of its enclosure 62*b*, distinguished from the acoustic suspension speaker unit. The reflex speaker unit discharges compressed air, generated caused by motion of a diaphragm (not shown), through the duct 63 to the outside and generates a sound according to reaction to the outflow of the compressed air. Here, an acoustic phase difference generates when the sound generated behind the speaker is emitted through the duct 63 so that the phase of the sound generated behind the speaker coincides with the phase of the sound emitted from the front of the speaker.

In both of the acoustic suspension and reflex speaker units, their diaphragms generate sounds having the same intensity but opposite phases in front of and behind the speaker. Frequency characteristic of sound is varied when the sound generated behind speaker interferes the sound generated in front of the speaker. The enclosure effectively prevents the interference or copes with it.

FIG. 7 is a cross-sectional view of a conventional speaker unit. The conventional speaker unit such as an earphone emits sound waves generated behind its diaphragm and compressed air generated when the sound waves are created through a plurality of fine holes 1*a* and 1*b* formed at the back side of a casing of the speaker unit to the outside. That is, the conventional speaker unit employs a reflex speaker that discharges sound waves to the back of the casing, to emit the sound waves and compressed air through the holes 1*a* and 1*b*. At this time, the compressed air is transmitted to the eardrum of a user to fatigue the user's ears. Furthermore, due to the compressed air and sound waves generated from the back of the diaphragm, a sound different from the original sound is transmitted to the eardrum in terms of characteristic of the conventional two-channel earphone. Moreover, only a short sound field exists between the eardrum and the earphone to transfer unnatural sounds to the listener.

DISCLOSURE OF INVENTION

Accordingly, the present invention has been made in view of the above problems, and an object of the present invention is to provide a virtual multi-channel speaker unit in which a small-size micro speaker unit is simply physically shaped into a specific form to form a virtual four-channel in the speaker so that compressed air transmitted to the eardrum is cancelled to reduce a listener's fatigue and generate deep and full timbre, thereby improving sound quality.

Another object of the present invention is to provide a virtual multi-channel speaker unit having a sound absorbent for preventing a specific sound from being amplified in a transmission conduit so as to prevent resonance that may generate when sounds are transmitted through a passage or conduit.

Yet another object of the present invention is to provide a virtual multi-channel speaker unit that has a transmission conduit composed of a plurality of thin conduits having various directions, lengths and hole shapes to create a specific sound or obtain multi-channel effect.

To accomplish the objects, according to the present invention, there is provided a virtual multi-channel speaker unit, comprising a casing having a transmission portion through which sounds pass; a solenoid coil arranged in the casing and applied with acoustic signals; a magnetic body around which the solenoid coil is wound to form magnetic field; a diaphragm that faces one side of the magnetic body and vibrates to transmit sound waves through the transmission portion; and a transmission conduit having an inlet hole through which sound waves and compressed air generated behind the diaphragm upon the vibration of the diaphragm are introduced, and an outlet hole for discharging the sound waves and compressed air introduced through the inlet hole, the inlet hole being connected to a portion of the backside of the casing, the outlet hole being oriented toward the front of the diaphragm.

Preferably, the transmission conduit is constructed in a manner that a sound absorbent is formed at all passages through which sounds are transmitted in the transmission conduit in order to prevent a specific sound from being amplified in the transmission conduit.

Preferably, the transmission conduit is composed of multiple conduits formed in a bundle of at least one to ten conduits each having a small diameter.

Also preferably, the transmission conduit composed of the multiple conduits is constructed in such a manner that outlet holes of the multiple conduits are separately formed at the top, right and left sides of the speaker unit.

It is preferred that the multiple conduits have different distances or lengths from their inlet holes to the outlet holes, to create characteristic sounds according to the directions of the conduits and the number of conduits.

It is also preferred that the transmission conduit of the speaker unit has any one of a semi-circular shape, oval shape and trumpet shape, to allow a listener to hear sounds more effectively.

Furthermore, the speaker unit of the present invention is constructed in such a manner that a conduit is formed in front of the diaphragm and combined with the transmission conduit formed at the backside of the casing to create a multi-channel effect.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

The present invention will now be described in detail in connection with preferred embodiments with reference to the accompanying drawings. The accompanying drawings illustrate examples for explaining preferred embodiments of the present invention so that the scope of the present invention is not to be restricted by the drawings or explanation with reference to the drawings.

Figure 1:
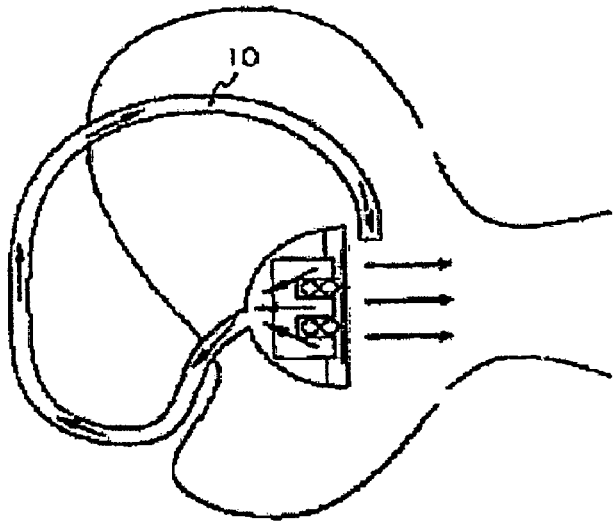
FIG. 1 is a diagram for explaining a virtual multi-channel speaker unit according to an embodiment of the present invention.
Figure 2:
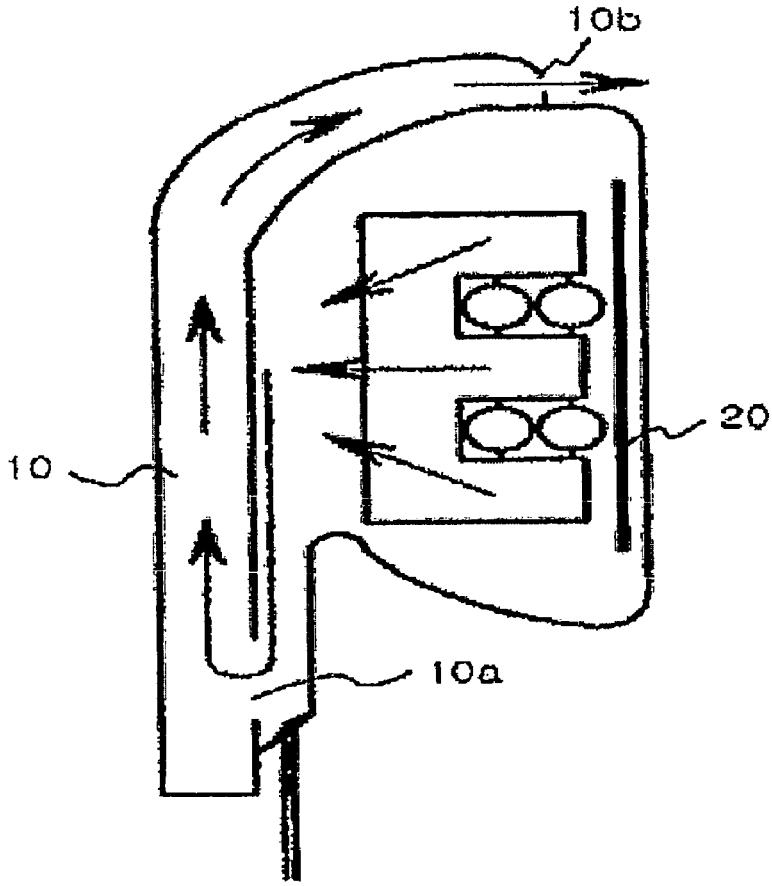
FIG. 2 illustrates an example of a transmission conduit of the speaker unit according to the present invention.
Figure 3:
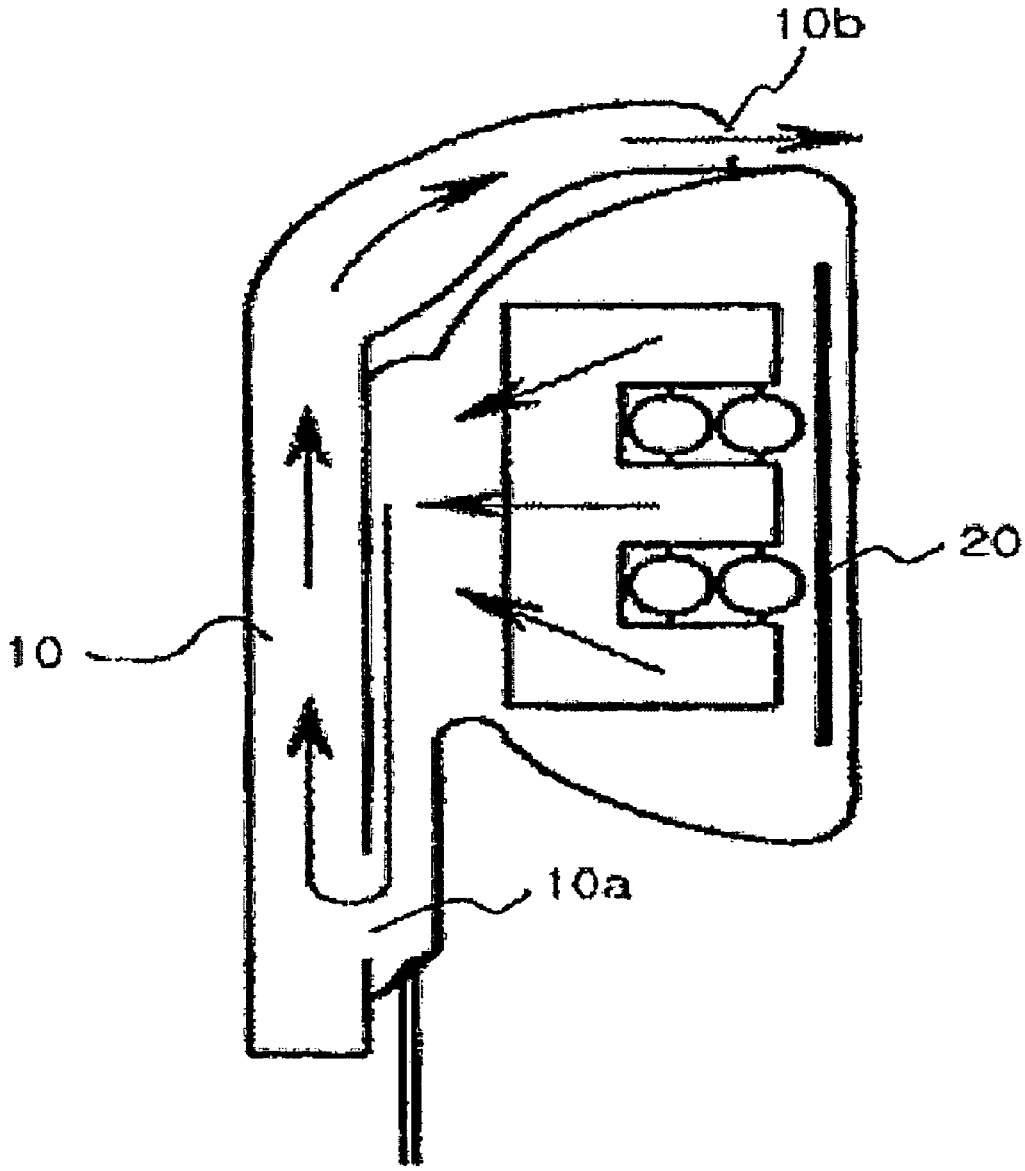
FIG. 3 illustrates another example of a transmission conduit of the speaker unit according to the present invention.
Figure 4:
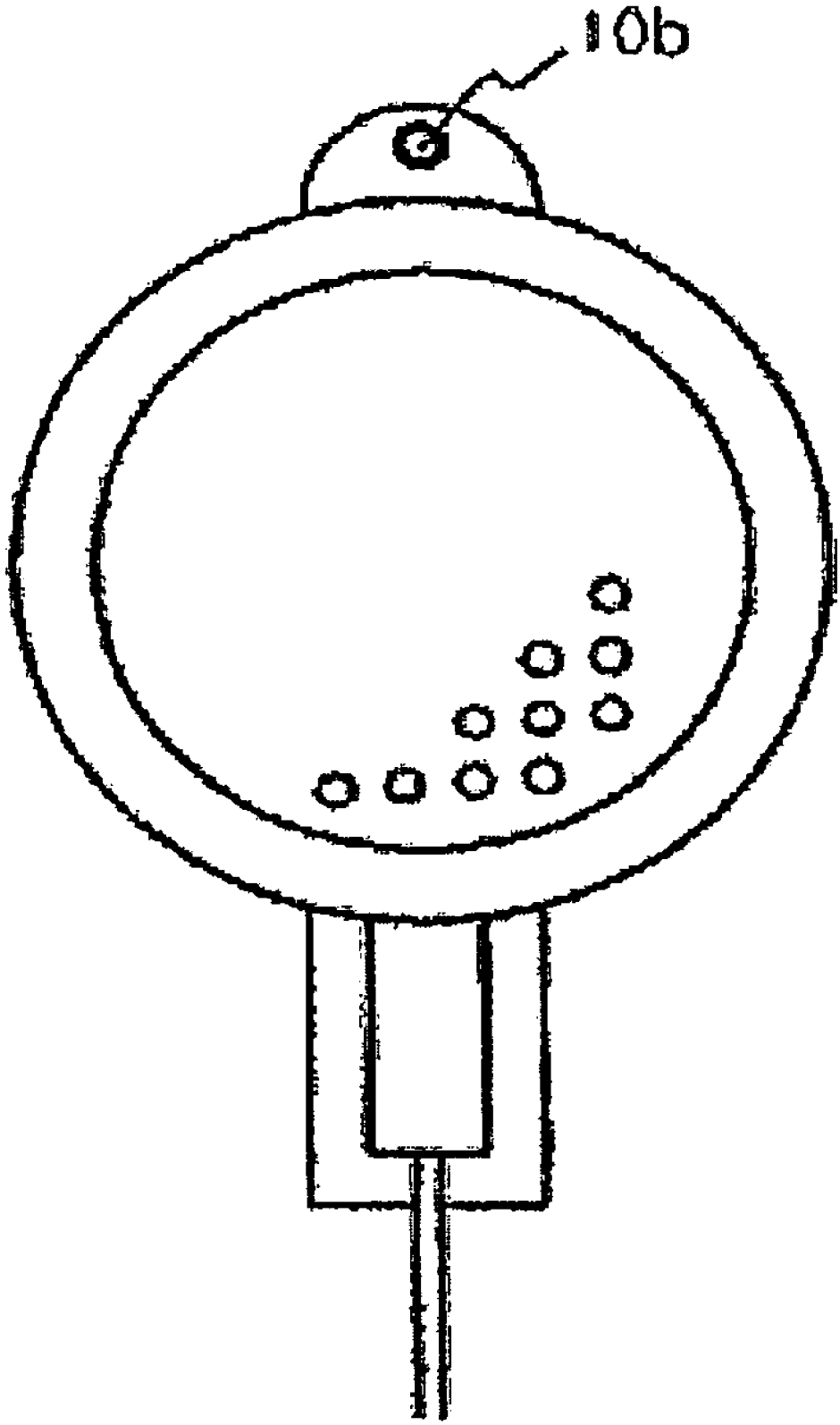
FIG. 4 is a front view of the virtual multi-channel speaker unit according to the present invention.
Figure 5:
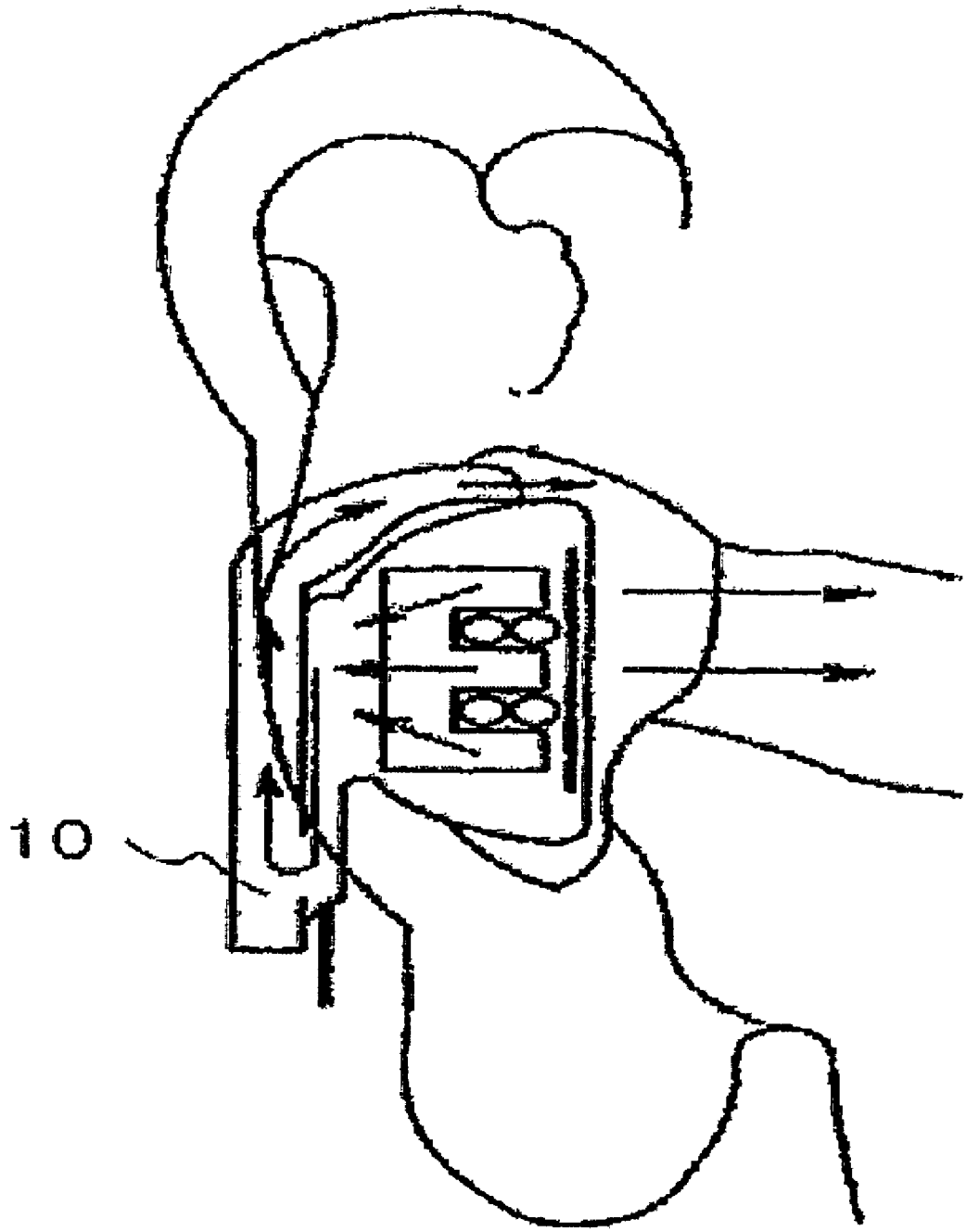
FIG. 5 is a perspective view of the virtual multi-channel speaker unit according to the present invention.
Figure 6:
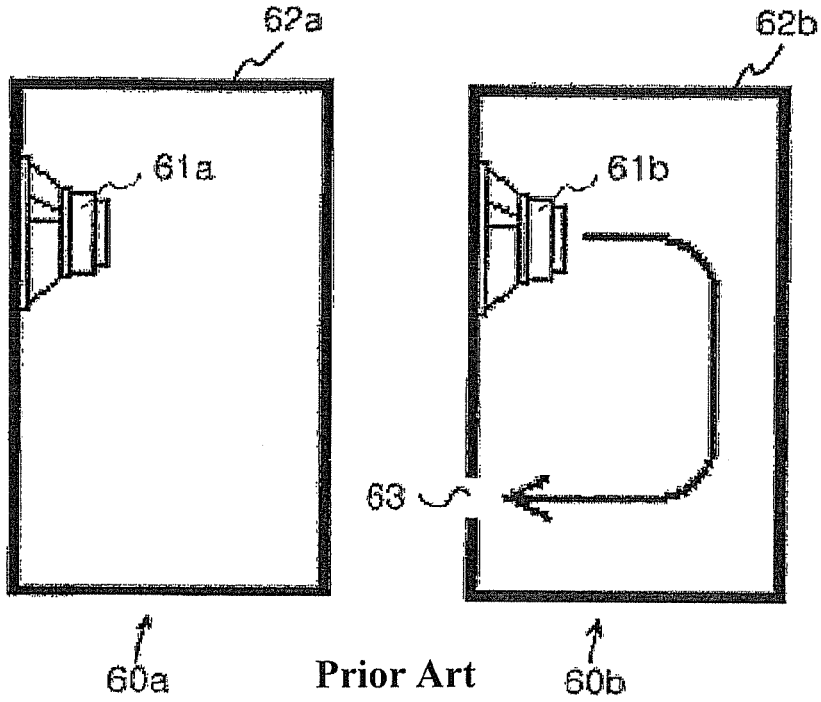
FIG. 6 illustrates various types of speaker units.
Figure 7:
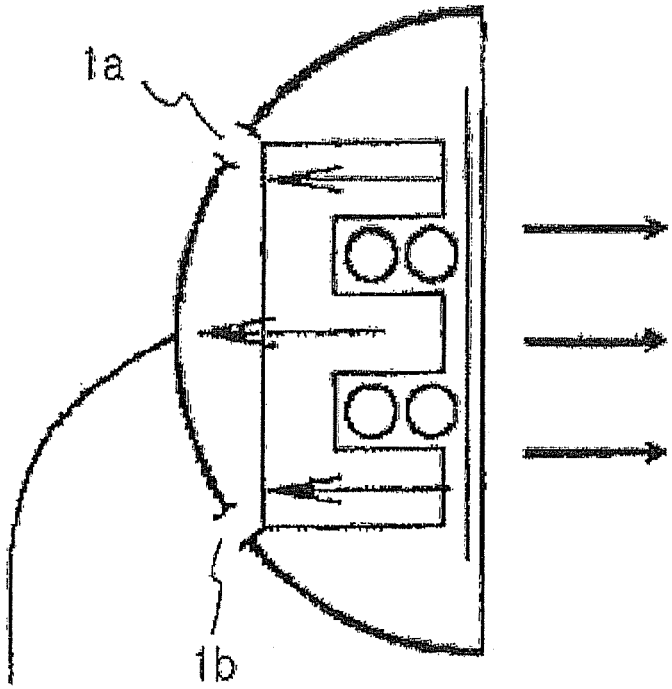
Prior Art Figure 7
FIG. 7 is a cross-sectional view of a conventional speaker unit.

FIG. 1 is a diagram for explaining a virtual multi-channel speaker unit according to an embodiment of the present invention, FIGS. 2 and 3 illustrate examples of a transmission conduit of the speaker unit according to the present invention, FIG. 4 is a front view of the virtual multi-channel speaker unit according to the present invention, and FIG. 5 is a perspective view of the virtual multi-channel speaker unit according to the present invention The virtual multi-channel speaker unit according to the present invention has a transmission conduit 10 through which sound waves and compressed air generated behind a diaphragm 20 are transferred, which is formed at the back of the speaker unit.

When an acoustic signal is outputted from an audio amplifier, for example, the acoustic signal flows through a solenoid coil and, at the same time, magnetic field is formed in a magnetic body, that is, magnet, around which the solenoid coil is wound, to vibrate the diaphragm 20 placed in close proximity to one side of the magnet. The vibration intensity of the diaphragm 20 varies with intensity of the acoustic signal and magnitude of the magnetic field of the coil. That is, the vibration is generated according to interaction of the magnetic field applied to the solenoid coil and the magnetic field of the magnet. Thus, the diaphragm 20 vibrates according to the intensity of the acoustic signal to oscillate the surrounding transmission medium, that is, air, so as to transmit sound waves.

In other words, when an electric signal is applied to the diaphragm 20 of the speaker, the diaphragm 20 vibrates according to electromagnetic force of the coil and permanent magnet and the vibration of the diaphragm oscillates the surrounding air to convert the electric signal into sound waves.

In general, the audio frequency band is 20~20000 Hz so that people can hear sounds when the sounds are converted within this band. The momentum of diaphragm 20 varies with intensity of current of the electric signal, and wave caused by varying momentum is transferred to a listener's ear to be recognized as a sound by the listener.

Here, when the diaphragm 20 vibrates, air pressure having the same intensity as that of air pressure formed in front of the diaphragm 20 and having a sign opposite to that of the air pressure is generated behind the diaphragm 20. That is, when positive pressure having a predetermined magnitude is generated in front of the diaphragm 20, negative pressure having the same magnitude as that of the positive pressure is generated behind the diaphragm.

The negative pressure is transmitted to the space between the diaphragm 20 and the listener's eardrum through the transmission conduit 10 one end of which is connected to a portion of the back of the casing. In the space between the diaphragm 20 and the eardrum, the negative pressure is cancelled by the positive pressure formed in front of the diaphragm 20 and, simultaneously, the positive pressure is cancelled.

A preferred embodiment of the transmission conduit 10 of the present invention is explained below.

As shown in FIG. 2, a barrier having an inlet hole 10*a* through which sound waves and compressed air generated behind the diaphragm 20 are introduced is formed at a predetermined place inside the speaker unit having the solenoid coil, magnet and diaphragm 20. The barrier separates the diaphragm 20 from the space of the backside of the casing. That is, the diaphragm 20 and backside of the casing are respectively located in front of the barrier and behind the structure. Preferably, the barrier is made of rubber or silicon in order to prevent sounds from being echoing. The barrier and the backside of the casing form a predetermined space, that is, transmission conduit 10. The top of the casing and the top of the barrier are extended toward the front of the diaphragm 20, and an outlet hole 10*b* through which the sound waves and compressed air emanate is formed at the front end of the transmission conduit 10 extended toward the front of the diaphragm 20.

The virtual multi-channel speaker unit of the present invention may be constructed in such a manner that the conventional speaker unit is integrated with the transmission conduit 10 without having the barrier. For example, in the course of manufacturing the conventional speaker unit, the inner face of the casing of the speaker unit is partially protruded behind the diaphragm 20 to divide the inner space of the casing and the top of the backside of the casing and the outer side of the protrusion are extended toward the front of the diaphragm.

As shown in FIG. 3, the transmission conduit 10 of the present invention can be integrated with the conventional speaker unit. For instance, a hole is formed in a portion of the backside of the conventional speaker unit to form the inlet hole 10*a*, and the transmission conduit 10 having an inlet hole 10*a* corresponding to the inlet hole 10*a* is shaped along the curved face of the backside of the speaker unit. The other end of the transmission conduit 10 is extended from the curved face of the backside of the speaker unit toward the front of the diaphragm 20. The outlet hole 10*b* through which the sound waves and compressed air introduced into the conduit through the inlet hole 10*a* are discharged is formed at the other end of the transmission conduit 10. The transmission conduit 10 is combined with the casing using an adhesive having strong adhesive strength such as epoxy resin.

Sound waves generated at the same time when negative pressure is generated behind the diaphragm 20 are transmitted through the transmission conduit 10 to the front of the diaphragm 20 together with the compressed air. At this time, timbre including a temporal change corresponding to the length of the conduit is formed. Sounds with a variety of timbres are generated according to the length of the transmission conduit 10, and they are heard as timbre of a channel different from sound waves generated in front of the diaphragm 20. The sound waves generated behind the diaphragm 20 are transmitted through the transmission conduit 10 and discharged through the outlet hole 10*b*, creating a difference between the sound waves generated in front of the diaphragm and sound waves generated behind the diaphragm. This difference is added to the sound waves formed in front of the diaphragm 20 so that increased sound is heard and volume slightly raises, generating a sound of multi-channel speaker.

The sound generated behind the diaphragm 20 forms a sound field as long as the length of the transmission conduit 10 while passing through the transmission conduit 10 and forms timbre having a temporal change from the timbre generated in front of the diaphragm 20. The sound field is defined as the range of sound source, which is felt when sound is heard. That is, the sound field is the width of arrangement of speakers that a listener feels. The sound filed of a sound outputted from a speaker having excellent sound field is felt to be wider than the sound field of the original sound.

In the meantime, timbre is defined as characteristic sound that varies according to the surrounding environment or reproducing device. For example, sounds having the same tone can have different sound components and, even when identical sounds are propagated with the same intensity, there is generated a difference between timbres of the sounds according to a difference in pronunciation or vibration method.

The timbre difference allows sounds generated at both sides of a two-channel speaker unit to be recognized as multi-channel sounds so that a pair of speaker units provides a listener with the feeling that he/she hears multi-channel sounds according to transmission of sound waves through the transmission conduit.

Figure 8:
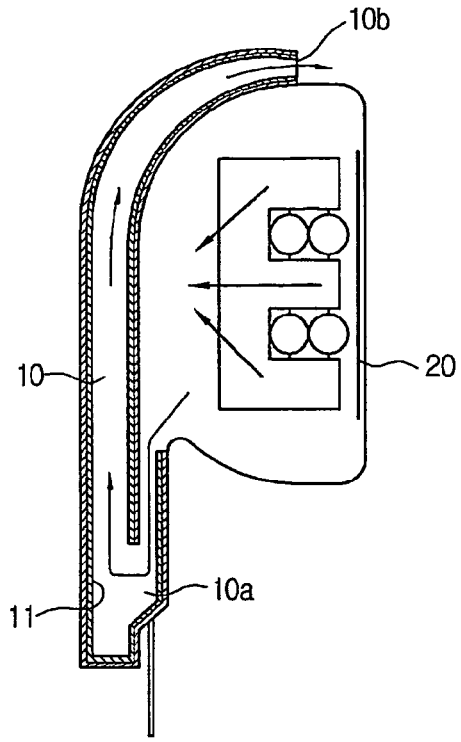
FIG. 8 illustrates a virtual multi-channel speaker unit according to another embodiment of the present invention.

FIG. 8 illustrates a virtual multi-channel speaker unit according to another embodiment of the present invention. Referring to FIG. 8, the speaker unit is constructed in such a manner that a sound absorbent 11 is formed at all passages through which sounds are transmitted in order to prevent a specific sound from being amplified in the transmission conduit 10. The sound absorbent 11 prevents resonance that may generate in the course of transmitting sounds through the conduit.

There is a phenomenon that a specific sound is amplified according to resonance or other physical factors during its transmission through a passage or conduit. This has a harmful effect on listening to music. In case of a music hall, recording room, large-sized indoor stage and so on, for instance, a geographical structure, cloth, sponge or paper egg package for absorbing sounds are attached onto their walls.

Accordingly, the speaker unit of the present invention, distinguished from general earphones, has the sound absorbent 11 formed at all passages through which sounds are transmitted in order to prevent a specific sound from being amplified in the transmission conduit 10 or the space surrounding the earphone speaker. The sound absorbent 11 can use any material that can absorb sounds, such as non-woven fabric, wool, pulp, textiles, sponge, cotton and so on.

As shown in FIG. 8, the sound absorbent 11 is formed on the inner wall of the transmission conduit 10 in order to prevent vibration through the casing from resonating with sounds in the transmission conduit 10.

Figure 9:
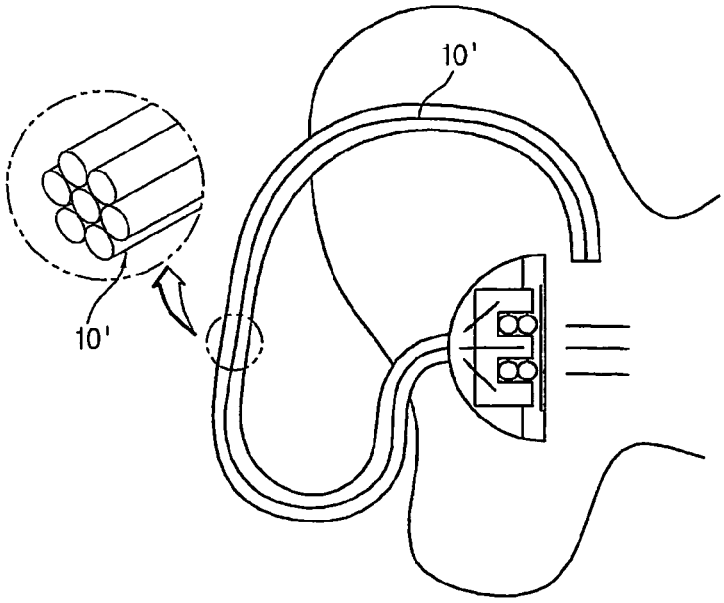
FIG. 9 illustrates a virtual multi-channel speaker unit according to another embodiment of the present invention.

FIG. 9 illustrates a virtual multi-channel speaker unit according to another embodiment of the present invention. Referring to FIG. 9, the transmission conduit 10 is composed of multiple thin conduits 10' (as many as at least one to ten).

Although a single transmission conduit is used in the embodiments shown in FIGS. 1 to 7, all the conduits of the embodiments can be constructed of the multiple conduits 10' as shown in FIG. 9. In this case, a specific sound can be generated or a multi-channel effect can be obtained using multiple conduits formed in a bundle of at least one to ten conduits each having a small diameter.

In the case where the transmission conduit is used in a headphone or other speaker units, a trumpet shape or a space in which sounds remain can be employed instead of the conduit. In this case, the transmission conduit of all speaker units using sounds generated behind the diaphragm can be composed of multiple conduits to obtain a multi-channel effect.

Figure 10:
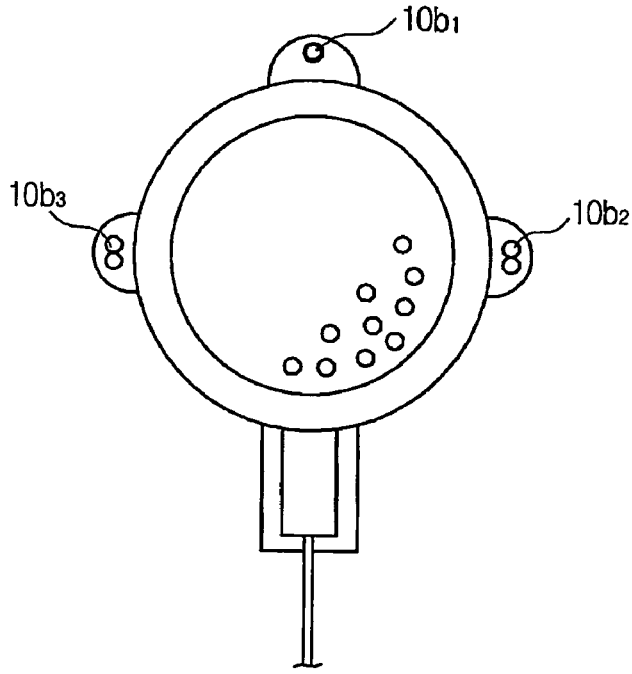
FIG. 10 illustrates a virtual multi-channel speaker unit according to another embodiment of the present invention.

FIG. 10 illustrates a virtual multi-channel speaker unit according to another embodiment of the present invention. Referring to FIG. 10, multiple conduits 10' constructing the transmission conduit are separately placed at the top, right and left sides of the earphone speaker such that a plurality of outlet holes 10'*b*1, 10'*b*2 and 10'*b*3 are separately distributed. The multiple conduits 10' can be selectively located in only one direction among the three directions or they can be arranged separately as shown in FIG. 10. Accordingly, the multi-channel effect is recognized as sounds heard from the top, right or left side according to the direction of the conduits. With this construction, various characteristic and interesting sounds can be generated.

Figure 11:
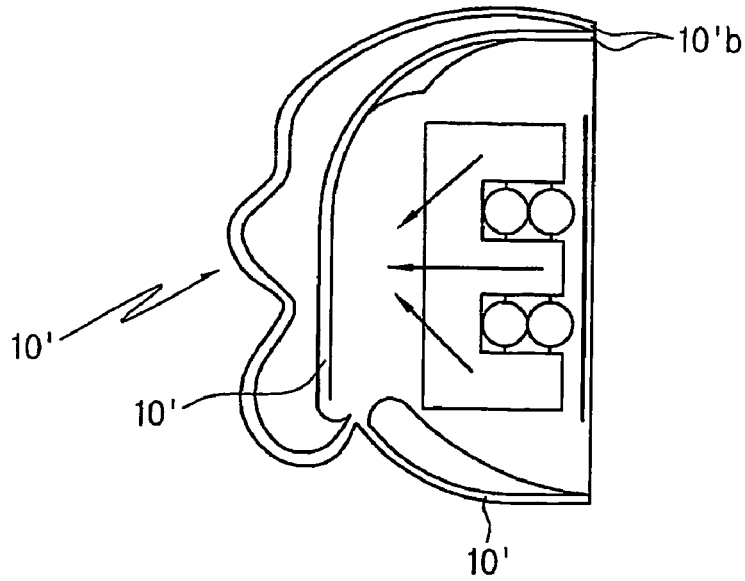
FIG. 11 illustrates a virtual multi-channel speaker unit according to another embodiment of the present invention.

FIG. 11 illustrates a virtual multi-channel speaker unit according to another embodiment of the present invention. Referring to FIG. 11, the transmission conduit is composed of multiple conduits 10' having different lengths. The width of sound field is decided based on the length of the transmission conduit. In an embodiment of the present invention, the length of the transmission conduit, i.e., the distance from the diaphragm 20 to the outlet hole is about 24 mm. This transmission conduit is constructed of multiple conduits 10' having lengths of 10 mm to 50 mm and being respectively arranged in different directions so that a characteristic multi-channel effect can be obtained.

Although the speaker unit of the present invention in the above embodiments has the shape of a triangle whose corner is rounded, it can have various forms including a semi-circle, trumpet shape and so on.

Furthermore, the speaker unit of the present invention can be constructed in such a manner that a conduit is formed in front of the diaphragm and combined with the transmission conduit formed at the backside of the casing to create a multi-channel effect.

INDUSTRIAL APPLICABILITY

As described above, the virtual multi-channel speaker unit according to the present invention cancels compressed air applied to the listener's eardrum to reduce fatigue and diversifies timbre to improve sound quality.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A virtual multi-channel speaker unit, comprising:

a casing having a transmission portion through which sounds pass;

a solenoid coil arranged in the casing and applied with acoustic signals;

a magnetic body around which the solenoid coil is wound to form magnetic field;

a diaphragm (20) that faces one side of the magnetic body and vibrates to transmit sound waves through the transmission portion;

a barrier separating the diaphragm (20) from a backside of the casing; and a transmission conduit (10) formed by the barrier and the backside of the casing, the transmission conduit having an inlet hole (10*a*) through which sound waves and compressed air generated behind the diaphragm upon the vibration of the diaphragm are introduced, and an outlet hole (10*b*) for discharging the sound waves and compressed air introduced through the inlet hole, the inlet hole being connected to a portion of the backside of the casing, the outlet hole being oriented toward the front of the diaphragm.

2. A virtual multi-channel speaker unit comprising:

a casing having a transmission portion through which sounds pass;

a solenoid coil arranged in the casing and applied with acoustic signals;

a magnetic body around which the solenoid coil is wound to form magnetic field;

a diaphragm (20) that faces one side of the magnetic body and vibrates to transmit sound waves through the transmission portion; and a transmission conduit (10) having an inlet hole (10*a*) through which sound waves and compressed air generated behind the diaphragm upon the vibration of the diaphragm are introduced, and an outlet hole (10*b*) for discharging the sound waves and compressed air introduced through the inlet hole, the inlet hole being connected to a portion of the backside of the casing, the outlet hole being oriented toward the front of the diaphragm, wherein the transmission conduit (10) is constructed in a manner that a sound absorbent (11) is formed at all passages through which sounds are transmitted in the transmission conduit in order to prevent a specific sound from being amplified in the transmission conduit (10).

3. A virtual multi-channel speaker unit comprising:

a casing having a transmission portion through which sounds pass;

a solenoid coil arranged in the casing and applied with acoustic signals;

a magnetic body around which the solenoid coil is wound to form magnetic field;

a diaphragm (20) that faces one side of the magnetic body and vibrates to transmit sound waves through the transmission portion; and a transmission conduit (10) having an inlet hole (10*a*) through which sound waves and compressed air generated behind the diaphragm upon the vibration of the diaphragm are introduced, and an outlet hole (10*b*) for discharging the sound waves and compressed air introduced through the inlet hole, the inlet hole being connected to a portion of the backside of the casing, the outlet hole being oriented toward the front of the diaphragm, wherein the transmission conduit (10) is composed of multiple conduits (10') formed in a bundle of at least one to ten conduits each having a small diameter.

4. The virtual multi-channel speaker unit as claimed in claim 3, wherein outlet holes (10'*b*1, 10'*b*2 and 10'*b*3) of the multiple conduits are separately formed at the top, right and left sides of the speaker unit.

5. The virtual multi-channel speaker unit as claimed in claim 3, wherein the multiple conduits (10') have different distances or lengths from their inlet holes to the outlet holes.

6. The virtual multi-channel speaker unit as claimed in claim 1, wherein the transmission conduit (10) of the speaker unit has any one of a semi-circular shape, oval shape and trumpet shape.

7. The virtual multi-channel speaker unit as claimed in claim 1, further comprising a front transmission conduit having an inlet hole through which sounds generated in front of the diaphragm (20) of the speaker are introduced into the front transmission conduit and an outlet hole for discharging the introduced sounds, the inlet hole being placed in front of the diaphragm, the outlet hole being oriented toward the front of the speaker, whereby combination of the front transmission conduit and the transmission conduit (10) creates a multi-channel effect.

* * * * *